US005848800A

United States Patent [19]

Metzler et al.

[11] Patent Number: 5,848,800

[45] Date of Patent: Dec. 15, 1998

[54] SKI

[75] Inventors: Ullrich Metzler; Michael Broger, both of Dornbirn; Rainer Nachbaur, Fraxern, all of Austria

[73] Assignee: Kastle Aktiengesellschaft, Hohenems, Austria

[21] Appl. No.: 985,024

[22] Filed: Dec. 4, 1997

Related U.S. Application Data

[63] Continuation of Ser. No. 564,079, Dec. 8, 1995, abandoned.

[30] Foreign Application Priority Data

Jun. 9, 1993 [AT] Austria ..... 1119/93

[51] Int. Cl.[6] ..... A63C 5/12

[52] U.S. Cl. ..... 280/610

[58] Field of Search ..... 280/601, 608, 280/609, 610

[56] References Cited

U.S. PATENT DOCUMENTS

| | | |
|---|---|---|
| 3,270,111 | 8/1966 | Haldemann . |
| 3,493,240 | 2/1970 | Jenks . |

FOREIGN PATENT DOCUMENTS

| | | |
|---|---|---|
| 223088 | 8/1962 | Austria . |
| 241311 | 7/1965 | Austria . |
| 309282 | 8/1973 | Austria . |
| 389848 | 2/1990 | Austria . |
| 0081834 | 11/1985 | European Pat. Off. . |
| 0320487 | 6/1989 | European Pat. Off. . |
| 0428885 | 5/1991 | European Pat. Off. . |
| 0211050 | 7/1991 | European Pat. Off. . |
| 0459347 | 12/1991 | European Pat. Off. . |
| 2424470 | 11/1979 | France . |
| 2679780 | 2/1993 | France . |
| 1220770 | 7/1966 | Germany . |
| 1264743 | 3/1968 | Germany . |
| 2406145 | 8/1974 | Germany . |
| 2526108 | 1/1976 | Germany . |
| 2433673 | 5/1979 | Germany . |
| 3236016 | 4/1984 | Germany . |
| 8703833 | 7/1987 | Germany . |
| 3936378 | 7/1992 | Germany . |
| 4124519 | 1/1993 | Germany . |
| 3924661 | 3/1994 | Germany . |

*Primary Examiner*—Richard M. Camby
*Attorney, Agent, or Firm*—Lorusso & Loud

[57] ABSTRACT

A ski having a stressed-skin design, in which the inner supporting structure is covered at the sides and above by a skin of preferably un-reinforced plastic which is joined to a flat bottom assembly consisting at least of the running surface and, optionally, steel edges. The internal space between the upper skin, consisting of a shaped plastic top sheet, and the components making up the bottom assembly contains one or more hollow bodies whose walls are made of fibre-reinforced plastic.

27 Claims, 3 Drawing Sheets

SKI

CROSS-REFERENCES TO RELATED APPLICATIONS

This is a continuation of application Ser. No. 08/564,079, filed Dec. 8, 1995, now abandoned, which is a national stage application of PCT/AT94/00048 filed Apr. 20, 1994, which corresponds to Austria Application A 1119/93 filed Jun. 9, 1993, the contents of which are incorporated herein by reference.

BACKGROUND OF THE INVENTION

1. Field of the Invention

The invention relates to a ski of monocoque design, in which the internal load-bearing assembly is covered laterally and above by a shell made from preferably unreinforced plastics material, which joins onto a flat, lower subassembly, composed of at least a base and optionally of steel edges.

2. Description of the Related Art

The latest trend in ski construction is in the direction of skis of monocoque design, known as "shell skis" or "cap skis".

Different proposals are known for the manufacturing of monocoque skis, for example the method of moulding a plastics sheath using the RIM process (Reaction Injection Moulding) onto a ski blank, the load-bearing construction of which is composed of an upper plate, lower plate and core. In this case the decoration has to be applied subsequently to the three-dimensionally configured surface of the ski (AT-B 390 196). According to another known proposal, a shell-like top part made from plastics material, optionally fibre-reinforced, with flange-like side edges, is manufactured in a mould designed specifically for this purpose, either together with the ski core or simply as a shell, wherein the top part of the ski prefabricated in this manner is joined to the bottom part of the ski, which is also prefabricated. When the top part of the ski is firstly just produced as a shell, after its joining to the bottom part of the ski, the enclosed hollow space formed thereby is expanded. A separate decoration layer applied to the shell is preferably provided for decorating of the ski (EP-A 0 394 835). Again, another known method provides that the multi-layered shell material is laid in a flat configuration on the mould cavity, wherein the edge areas of the flat shell material firstly project laterally over the mould cavity, whereupon the shell material is pressed into the mould cavity with the aid of the prefabricated ski core, and in this way the shell is made into its final shape and then finally joined to the bottom part of the ski, for example by gluing (DE-C 38 03 483). A further known proposal is that a flexible, thin walled film made from plastics material is placed in the mould cavity of a top mould, and that the foil conforms to the wall of the mould cavity; after this, the top mould, lined in this manner, is placed on the bottom mould, which contains the load-bearing ski construction with a lower plate, upper plate and core, and the remaining hollow space is filled with foam. The decoration can be applied to the covering foil before or after carrying out this process (EP-A 0 498 963).

SUMMARY OF THE INVENTION

The object of the invention is to provide a monocoque ski which, while having good strength properties, is distinguished by being lightweight, and can be produced efficiently.

This is solved according to the invention in that one or more hollow bodies with walls made from fibre-reinforced plastics are arranged in the space enclosed by an upper shell moulded from a plastics covering foil and the components of the lower, flat, subassembly component. The hollow body or bodies fill the internal space between the shell and the components of the flat, lower, subassembly. The hollow bodies conceived are those which extend in the longitudinal direction of the ski, preferably substantially over the whole length of the ski. The hollow body or bodies can preferably be formed from peripherally enclosed synthetic resin-fibre material tubes shaped by inflation.

It was proposed some time ago to manufacture skis having with one or more hollow bodies made from fibre-reinforced plastics material (see, for example, AT-B 223 088, AT-B 241 311). However, until now, during manufacture of monocoque skis of the type described in the introduction, other constructions have been used without exception. The invention is now based on recognition that the previously known hollow body construction is also suitable, in a modified form, for the manufacture of a monocoque ski, the upper shell of which is moulded from a foil made of preferably unreinforced plastics, wherein it is possible to produce the greatest variety of three-dimensional configurations of the ski, and respectively of the shell.

The manufacture of such a ski can, as is usual, be carried out using a mould composed of two half-moulds, in the mould cavity of which the shaping of the ski takes place, wherein the following procedural steps are provided according to the invention:

a) the components of the lower subassembly are inserted in the cavity of the first half-mould;

b) one or more tubular, synthetic resin-impregnated fibre-material sheet configurations are provided with internal hoses of air-tight material, and positioned in the mould, for example placed on the components of the lower subassembly inserted in the first half-mould;

c) further, a covering foil made from plastics material, optionally provided with a decoration and/or an external protective foil, is positioned in the mould, for example, over the synthetic resin-fibre material tube(s) (if these have already been positioned), wherein the side edges of the covering foil overhang the cavity of the first half-mould;

d) when the second half-mould, with a mould cavity corresponding to the side and top surface contour of the ski body, is placed on the first half-mould, the projecting edges of the covering foil are positioned, but not clamped, in gaps in the edges between the second half-mould and first half-mould in a manner filling in said gaps;

e) the internal air-tight hose or hoses inside the synthetic resin-fibre material tube(s) are inflated with compressed air, whereby they expand and the synthetic resin-fibre material tube(s) is (are) also expanded, whereby the edge zones of the covering foil located in the gap in the edges between the second half-mould and the first half-mould are at least in part pulled out of the gap in the edge and the foil lies, without expansion or stretching, and without distortion of the decoration possibly applied on the internal wall of the second half-mould;

f) the synthetic resin of the synthetic resin-fibre material tube(s) is cured, while the internal pressure of the compressed air in the internal air-tight hose or hoses is retained, and optionally with heat being supplied.

After the end of the curing process, the excess pressure in the hoses is terminated and the ski taken out of the mould.

After removal from the mould, the miscellaneous edges of the covering foil overhanging the lateral surfaces of the lower subassembly are cut off, and possibly such that the cured synthetic resin of the hollow body or bodies forms a gap-filling web between the lateral bottom edge of the shell and the top surface of the lower, flat, subassembly, preferably the steel edge. With appropriate treatment of the ski tip and/or the tail of the ski, the hoses can be removed from the hollow spaces of the now cured hollow bodies for the purpose of being re-used. These hoses can, however, also remain in the interior of the hollow (8*a* in FIG. 1) chambers. If the covering foil has been provided with a protective foil, this protective foil is removed at the end of the manufacturing process.

The plastics covering foil conforming to the upper shell must be sufficiently flexible and therefore be relatively thin, for example, less than 1.0 mm, preferably approximately 0.5 mm, and if possible be composed of a plastics material with an elastic modulus below 5000 N/mm$^2$, preferably of 1000 N/mm$^2$ to 3000 N/mm$^2$. This range includes unreinforced, preferably thermoplastic materials such as, for example, ABS copolymers or polyamide.

A synthetic resin-impregnated, preferably textile fibre construction is used for the synthetic resin-fibre material tubes, wherein the fibre construction can be in "seamless" tubular form, for example tubular braiding; otherwise, however, a flat fibre sheet construction, for example woven textile or unidirectional layers, can be formed into a tube. The fibres can be aligned in different directions in the fibre construction, for example at right-angles to the longitudinal extent of the tube in the case of a tubular braiding, possibly joined to woven-in fibre threads which extend in the longitudinal extent of the tubes. When selecting the angle of the diagonal threads, consideration must be taken of the fact that this angle alters when the internal air-tight hoses are inflated. Glass fibres and/or carbon fibres or the like can be used, for example. The synthetic resin with which the fibre construction is impregnated can be a heat-curable reaction resin, for example polyester resin or epoxy resin. Prepreg fleece or prepreg hoses, in which the matrix material can be of a thermoplastic or duroplastic nature, can also be used for the synthetic resin-fibre material tubes. With duroplastic matrix materials, the prepreg is in a pre-cured state. Even when starting with several synthetic resin-fibre material tubes, an integral (unitary) internal hollow body containing a corresponding number of hollow chambers can be obtained.

In addition to the synthetic resin-fibre material tubes, other strengthening layers can be placed in the mould, for example, fibre materials impregnated with synthetic resin or ready bonded and/or light metal; these additional strengthening layers are preferably coated with adhesive before being inserted in the mould. The inserts can serve to strengthen the ply layers, and like the synthetic resin-fibre material tubes extend over substantially the whole length of the skis or can be inserts delimited in the longitudinal direction of the ski, for example in the area of the bindings, for increasing the resistance to the screws being pulled out. The inserts can also be of three-dimensional design, such that they serve as damping or stabilising elements and possibly be indicated on the ski surface. With two or more adjacent hollow bodies or respectively hollow chambers separated by partition walls, preferably wedge or gusset shaped inserts can be arranged over and/or under the partition walls, which reduce the effective buckling distance of the partition walls.

The device serving to implement the method according to the invention is composed, in addition to working points for shaping and printing the plastics covering foil, and for preparing the synthetic resin-fibre material tubes with the internal air-tight hoses, is essentially composed of a two-part mould, wherein one half-mould is provided with a cavity for containing the components of the lower subassembly of the ski (base and steel edges), and the mould cavity of the other half-mould is configured to correspond to the three-dimensional side and/or surface contours of the ski. This corresponds in principle to the known state of the art.

However, a suitable mould for implementing the method according to the invention must additionally be provided with a compressed air terminal leading to the mould cavity, onto which the air-tight hoses inside the synthetic resin-fibre material tubes can be connected.

In addition the lateral enclosing surfaces of the first half-mould and of the second half-mould are configured so that when the mould is closed, a gap delimited by stops forms in the area of the enclosing surfaces which contains the edge zones of the covering foil, the height of which is approximately the same as the thickness of the covering foil.

Upwardly protruding projections can be configured on the enclosing surfaces of the first-half mould, possibly in connection with the gap forming stop surfaces on the enclosing surfaces of the first half-mould, on which the edges of the covering foil, applied in a curved state, can be supported for temporary retaining of the curvature, when the covering foil is positioned on the first half-mould.

While a gap for the covering foil forms when the mould is closed in the area of the enclosing surfaces of the half-moulds adjacent to the mould cavity, the edge areas of the enclosing surfaces of the half moulds lying outside when the mould is closed lie in a sealing manner on one another, wherein it is advantageous when separate thickening strips, made from elastically deformable material, for example from elastomeric plastics material, can be arranged on the external edge areas of the enclosing surfaces of the first half-mould and/or second half mould.

When synthetic resin-fibre material tubes with heat cured reaction resin systems are used, in order to cure the reaction resin, at least one of the half-moulds should be heatable. It would also be possible to cure the reaction resin by means of the supply of heated compressed air in the air-tight hoses located in the synthetic resin-fibre material tubes. Cold cure reaction resin systems, which do not require any additional supply of heat, can also be used.

The invention will now be explained with reference to the drawings.

DESCRIPTION OF THE PREFERRED EMBODIMENTS

Figure 1:
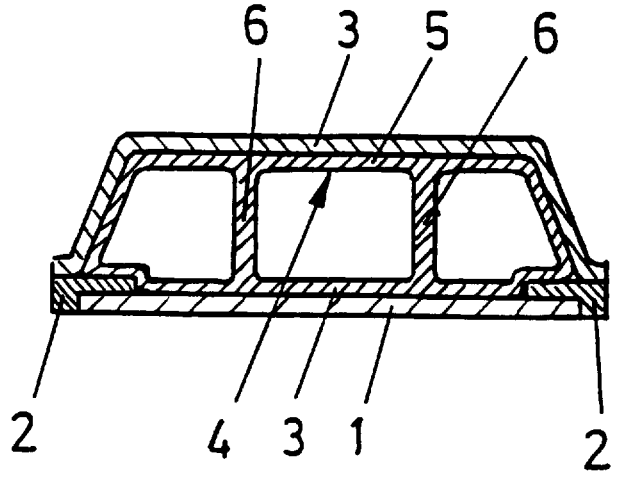
FIG. 1 is a cross-sectional view of one embodiment of the invention.

The ski according to FIG. 1 belongs to the category of monocoque skis,and is composed of a flat, lower subassembly with the base 1, for example made from polyethylene, and the lateral steel edges 2. The interior of the ski is enclosed laterally and above by a shell 3 of unreinforced plastics, for example ABS or polyamide. The internal load-bearing construction of the ski is formed by a hollow body 4, with walls 5, 6 made from fibre-reinforced thermoplastic or duroplastic material, for example glass fibre-reinforced polyester resin or epoxy resin. The internal hollow body 4 fills the internal space between the upper shell 3 and the lower subassembly 1, 2, such that the external walls 5 adjoin the internal walls of the shell 3, and respectively the lower subassembly 1, 2. The hollow body 4 is also provided with vertical partition walls 6, which divide the interior of the hollow body 4 into three air-filled hollow chambers. The hollow body 4 extends continuously substantially over the whole length of the ski. In the tip and tail areas, the hollow body 4 can possibly be replaced by special end components.

Figure 2:
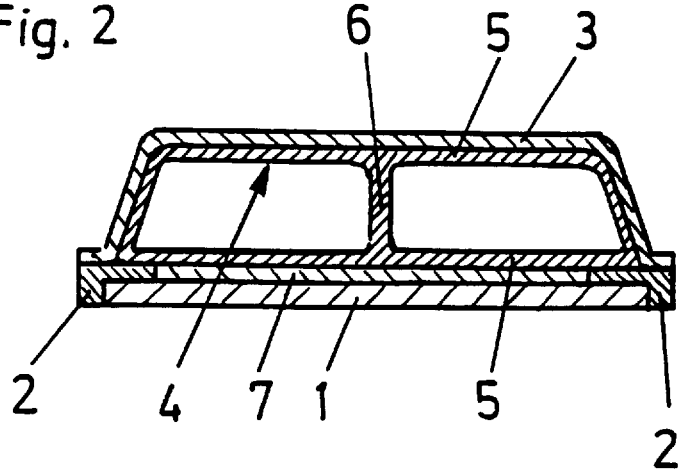
FIG. 2 is a cross-sectional view of another embodiment of the invention.

In the embodiment according to FIG. 2, the flat, lower subassembly is again composed from the base 1 and the steel edges 2, however in addition a continuous intermediate insert 7, which can be composed of load-bearing material, for example of fibre-reinforced plastics or metal, or respectively of unreinforced plastics material or wood, is provided over the length of the ski. Again, an outer shell 3 made of unreinforced plastics is provided, and in the interior a hollow body 4 with walls 5, 6 made from fibre-reinforced plastics. In the embodiment according to FIG. 2, the hollow body 4 is provided with only one vertical partition wall 6, which divides the interior of the hollow body into two air-filled hollow chambers.

Figure 4:
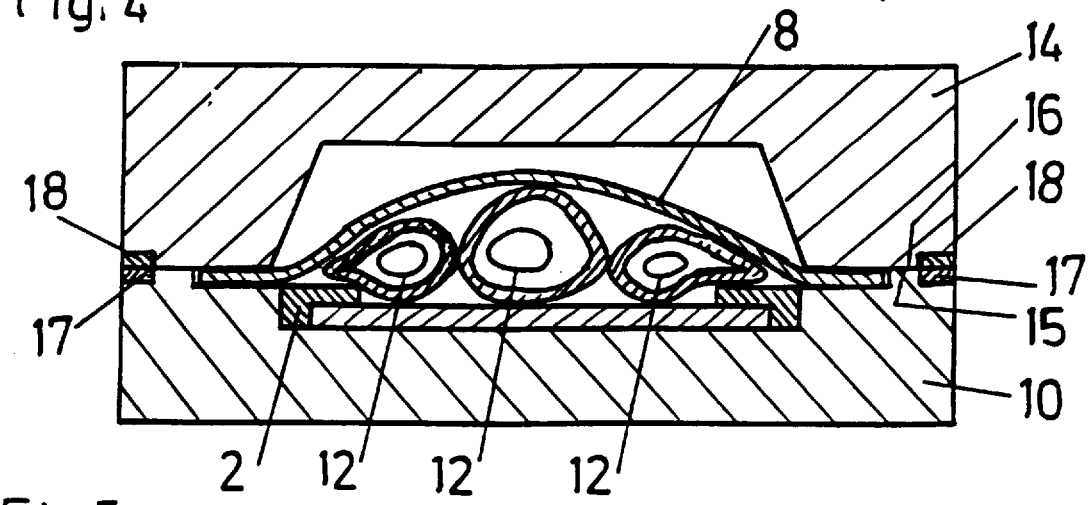
FIG. 4 is a cross-sectional view of components according to one embodiment of the invention situated between a lower half and an upper half of a mold at an early stage of the molding process.
Figure 5:
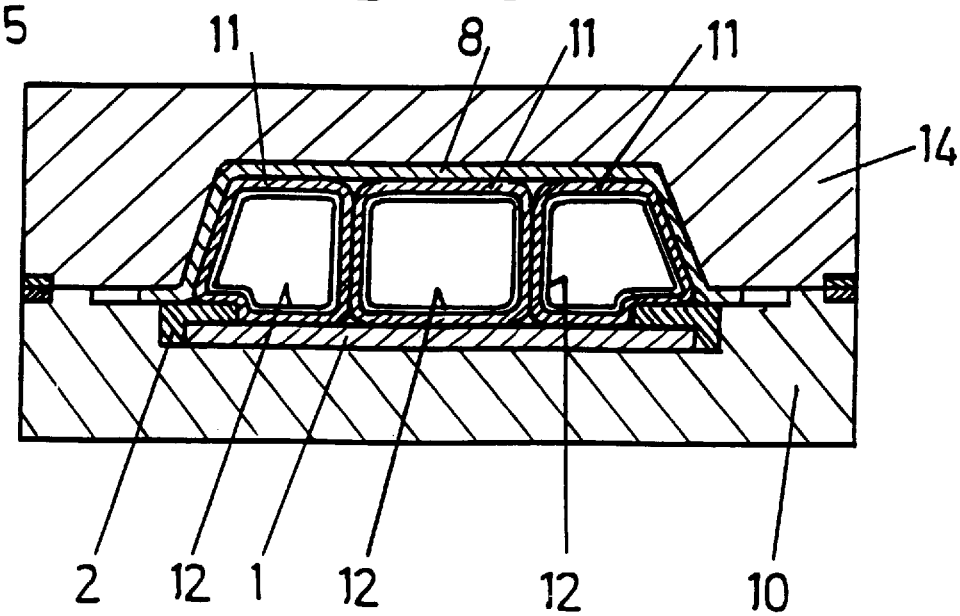
FIG. 5 is a cross-sectional view of components of an embodiment of the invention situated between a lower half and an upper half of a mold at a late stage of the molding process.

The method according to the invention for manufacturing a ski according to FIG. 1 will be explained with reference to FIGS. 3–5. Firstly,—in a step not shown in FIGS. 3–5—a covering foil 8 made from plastics, for example from ABS or polyamide, is provided with a decoration, in a flat configuration. Before applying the decoration, the covering foil can be transparent and is then printed upon, for example by screen printing, preferably on the side facing inwards when the ski is finished. The thickness of the foil can be, for example, 0.2–1.0 mm, preferably 0.5–0.6 mm. The covering foil 8 must be of a sufficient length and width, appropriate for the subsequent moulding. The covering foil can be a unitary foil composed of a single plastics material, or of areas of different, or differently coloured plastics material, which are for example bonded together one under another in a materially locking manner. In the processing state, however, a covering foil assembled in this manner is also unitary.

Figure 3:
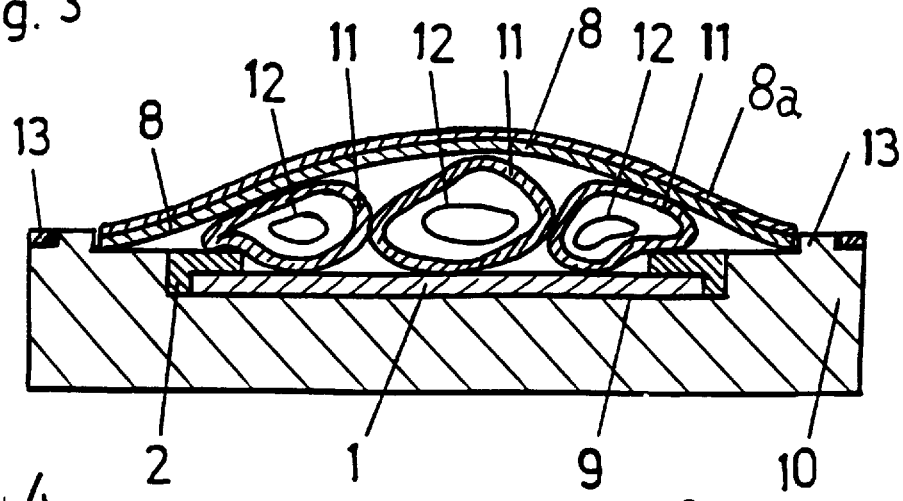
FIG. 3 is a cross-sectional view of components according to one embodiment of the invention situated in a lower half of a mold.

Thereafter, as shown in FIG. 3, the lower subassembly of the ski, namely the base 1 and the steel edges 2, are positioned in the cavity 9 of the first half-mould, in this case configured as the bottom mould 10. These components 1, 2 can already be bonded (glued) to one another prior to being positioned in the cavity 9 of the bottom mould 10. Thereafter synthetic resin-fibre material tubes 11 (in the case shown there are three), made for example from polyester resin or epoxy resin impregnated glass fibre tubular braiding, which are provided with internally located hoses 12 made from air-tight material, are positioned on the components 1, 2 of the subassembly of the ski. The covering foil 8 is thereafter laid over the synthetic resin-fibre material tubes 11, wherein the side edges of said covering foil laterally overhang the cavity 9 of the bottom mould, and are supported on projections 13 of the bottom mould.

After this, the second half-mould, which has a mould cavity corresponding to the side and top surface contours of the body of the ski (FIG. 4), in this case the top mould 14, is placed on the bottom mould 10. Both the enclosing surfaces 15 of the bottom mould 10 and the enclosing surfaces 16 or the top mould 14 are provided with thickening strips 17, 18 respectively, which are made from an elastically flexible material, for example from an elastomer plastics material. When the mould is closed, lateral gaps additionally form because of corresponding configuration of the enclosing surfaces 15, 16, which open out into the mould cavity. When the mould is closed, the lateral edge zones of the covering foil 8 come to lie in these gaps. The size of the gap is dimensioned such that the edge zones of the covering foil 8 just fill the gap, but are not clamped immovably in the gap.

The hoses 12 are, for example, connected at one of the longitudinal ends of the mould cavity to a compressed air supply configured in one of the half-moulds 10, 14. By turning on the compressed air supply, the hoses 12 are inflated, wherein they expand, and the synthetic resin-fibre material tubes 11 are also expanded. In this way, as shown in FIG. 5, the edge zones of the covering foil 8, located between the top mould 14 and bottom mould 10, are at least partially drawn out of the gap in the edge, and the covering foil 8 sits closely on the internal wall of the top mould 14, without expansion or stretching, and without deformation of the decoration possibly applied to the covering foil 8. With this, the synthetic resin-fibre material tubes 11 also reach the shape and position as shown in FIG. 5, wherein the synthetic resin of the synthetic resin-fibre material tubes is given off by the tubes because of the pressure exerted by the inflated hoses 12, and produces unbroken contact with the internal wall of the covering foil 8 and the components 1, 2 of the lower subassembly of the ski, and also between the individual synthetic resin-fibre material tubes 11. Adhesion with the covering foil 8, the arms of the steel edges 2 and the interior of the base is also effected by the synthetic resin of the synthetic resin-fibre material tubes 11. The synthetic resin given off by the synthetic resin-fibre material tubes 11 also effects the adherent connection (gluing) between the steel edges 2 and the preferably flange-type, outwardly curved edges of the covering foil 8. The synthetic resin can possibly also penetrate in between the arms and the base 1 and thereby also glue together these two components, if bonding of the steel edges with the base 1 has not already been carried out prior to being placed in the bottom mould. The three synthetic resin-fibre material tubes 11 also unite, as it were, to form a single integral structure composed of three hollow chambers.

The supply of heat for curing the synthetic resin is carried out while maintaining the internal compressed air pressure in the hoses 12. Advantageously, the supply of heat commences at the same time as the phase of expansion of the hoses 12, it can, however, also take place at a different time.

After curing, the mould is opened. Miscellaneous overhanging edges of the covering foil 8 are cut off. The covering foil 8 is thereby identical with the shell 3 shown in FIG. 1, and the synthetic resin-fibre material tubes 11 now form the integral hollow body shown in FIG. 1, with walls 5, 6 made from fibre-reinforced plastics and three hollow chambers.

Lastly, the hoses 12 can be removed from the chambers of the hollow body, through appropriate apertures in the area of the ski tip or the ski tail, wherein these apertures are subsequently closed, for example with a tip protector or tail protector.

Figure 6:
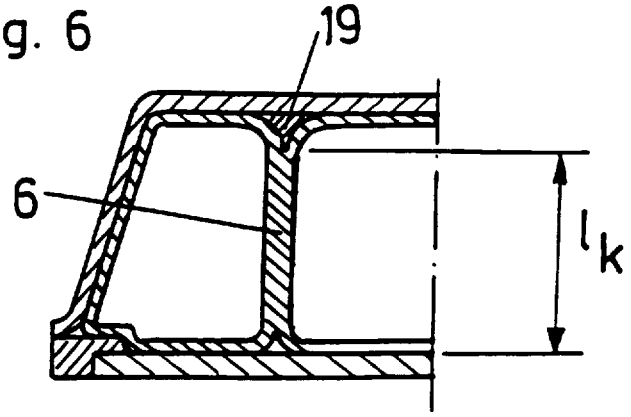
FIG. 6 is a partial cross-sectional view according to one embodiment of the invention.

It is advantageous, for determining running qualities, to pre-determine the deflection capacity of the ski, and to create it in a variable manner during manufacture. As shown in FIG. 6, this can take place, for example, by altering the free effective buckling length $l_K$ of the partition walls 6 by the use of wedge or gusset shaped elements 19. The wedge or gusset shaped elements 19 can be composed of prefabricated plastics sections, for example made from fibre-reinforced plastics in section form, or from wood in an appropriate strip shape.

Figure 7:
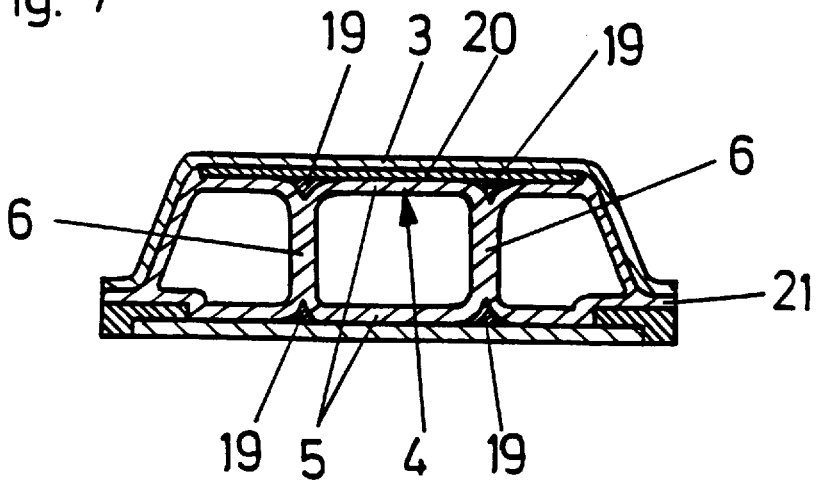
FIG. 7 is a cross-sectional view according to a further embodiment of the invention.

The cross-section of the ski according to FIG. 7 relates to an embodiment of a ski according to the invention, again with a lower, flat subassembly composed of a base 1 and steel edges 2 as well as an outer shell 3 of unreinforced plastics and an internal three-chamber hollow body 4 with walls 5, 6 made from fibre-reinforced plastics. Above and below the vertical partition walls 6, wedge or gusset shaped elements or configurations 19 are provided for reducing the free effective buckling length of the partition walls.

These elements or configurations can be formed from prefabricated inserts or by controlling the pressure during inflation of the synthetic resin-fibre material tubes forming the hollow body 4, wherein the synthetic resin escaping from the synthetic resin-fibre material composite forms the wedge or gusset shaped elements 19.

Further, in the embodiment according to FIG. 7, a strengthening layer 20 made from fibre-reinforced plastics or metal for strengthening the top plate, or for strengthening the area for attachment of the binding is provided between the exterior of the hollow body 4 and the interior of the shell 3. This strengthening layer 20 however extends only over the width of the top of the three-chamber hollow chamber 4, and not in the area of the side walls of the skis. The strengthening layer 20 can extend over the whole length of the ski or, however, only over a part area of the length, for example over the area for attachment of the binding. During manufacturing, preferably before the placing of the covering foil for the shell in the mould, the strengthening layer 20 is bonded, for example glued, to the still flat covering foil.

The lower lateral edges of the shell 3 are curved outwards in the manner of a flange. Their underside is located at a slight distance, for example approximately 0.5 mm, above the surface of the steel edges 2 (respectively over the surface of the lower, flat subassembly). During manufacturing of the ski in the mould the still flowable synthetic resin of the synthetic resin-fibre material penetrates into the hollow body 4, and after curing forms a web 21 of cured synthetic resin there, which guarantees particularly good bonding of the lateral edges of the shell 3 to the steel edges 2.

Figure 8:
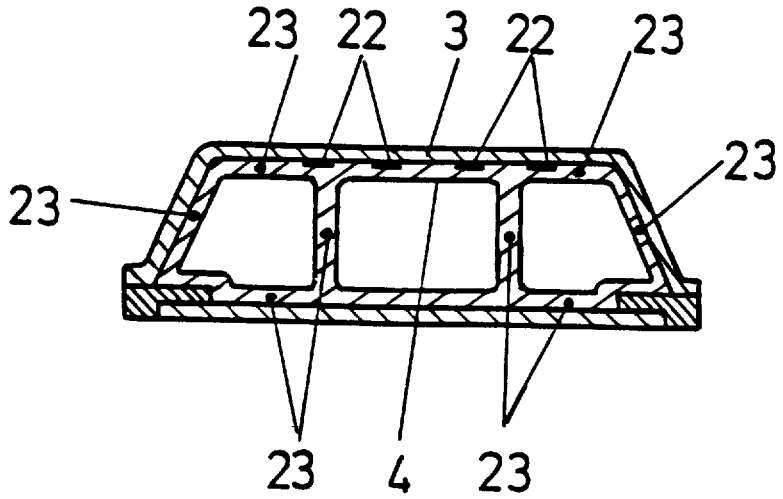
FIG. 8 is a cross-sectional view according to a still further embodiment of the invention.

With the embodiment according to FIG. 8, the basic structure of the ski is again composed of the flat, lower subassembly (base 1 and steel edges 2), the outer shell 3 and the inner load-bearing hollow body 4, which again in this case is a three-chamber hollow body. Strip-shaped strengthening inserts 22 made from synthetic resin bonded carbon fibres or metal are arranged between the surface of the hollow body 4 and the shell 3 made from unreinforced plastics. The walls of the two lateral hollow chambers of the hollow body 4, composed of a synthetic resin-glass fibre bond, also contain carbon fibre inserts 23. The thread-like carbon fibre inserts 23 can be interwoven with the glass fibre reinforcement, composed of a tubular braiding, of the synthetic resin-fibre material tubes, from which the hollow body 4 is formed. The lateral chambers of the hollow body 4 are reinforced with the carbon fibre inserts for the purpose of better support of the edge area of the ski. For this purpose, the lateral synthetic resin-fibre material tubes (as opposed to the middle synthetic resin-fibre material tube) can be provided with greater wall thickness and/or with a higher fibre content, for example glass fibre content.

As described with respect to FIG. 1, the hollow body 4 extends continuously substantially over the whole length of the ski. This is preferably also the case with the remaining embodiments. However, when as in FIG. 2 an additional load-bearing bottom plate layer 7 is present, and in FIG. 7 an additional load-bearing top plate layer 19, there would be the possibility of using a hollow body divided in the longitudinal direction of the ski, for example such that in both the front part and in the rear part of the ski, a separate hollow body is located, and in the central area (the area for attachment of the binding) there is a solid core.

With the embodiments shown, a trapezoid ski cross-section and correspondingly shaped mould cavity are selected, in particular for reasons of simplicity of representation. The invention allows other cross-sections, such as upwardly curved cross-sections, however, and a cross-section shape which can change in almost any manner in the longitudinal direction of the ski.

The method according to the invention and the construction according to the invention are suitable above all for downhill skis, but can also be used for cross-country skis, snowboards and other skis or ski-like sports equipment.

Having thus described our invention, what we claim as new and desire to secure by United States Letters Patent is:

1. A ski, of monocoque design, in which the internal load-bearing construction is covered laterally and above by a shell made from un-reinforced plastics material, which joins onto a flat, lower subassembly, comprising at least a base and steel edges, wherein a space enclosed by the shell formed from a moulded covering foil of plastics material, and the components of the lower, flat, subassembly, comprises a hollow body comprising at least two adjacently located hollow chambers extending in the longitudinal direction of the ski, with walls made from fibre-reinforced plastics material, wherein at least one partition wall made from fibre reinforced plastics material is located between two hollow chambers, formed from the wall material of the hollow chamber.

2. A ski according to claim 1, wherein in that the hollow body and, respectively, the hollow chambers extend substantially over the whole length of the ski, in the longitudinal direction of the ski.

3. A ski according to claim 1, wherein in that the hollow body is formed from peripherally enclosed, synthetic resin-fibre material tubes moulded by inflation.

4. A ski according to claim 1, wherein in that an integral hollow body, comprising at least two hollow chambers made from fibre-reinforced plastics material is arranged in the space enclosed by the shell and the lower flat subassembly.

5. A ski according to claim 1, wherein in that the adjacent walls of two neighboring hollow chambers and, respectively, synthetic resin-fibre material tubes form a common vertical partition wall.

6. A ski according to claim 1, wherein in that at least one additional insert is arranged between the hollow body and the shell and/or the lower subassembly.

7. A ski according to claim 6, wherein the at least one insert is made from load-bearing material, such as reinforced plastics material or metal.

8. A ski according to claim 5, wherein the at least one, extends at the most over the width of the top surface and/or the underside of the hollow body.

9. A ski according to claim 1, wherein the ski has at least two adjacent hollow chambers separated by partition walls, with wedge or gusset-shaped intermediate inserts situated over and/or under the partition walls to reduce an effective buckling length of the partition walls.

10. A ski according to claim 1, wherein the ski has at least three adjacent hollow chambers, the two lateral hollow chambers having a greater wall thickness and/or a higher content of reinforcing fibre than the middle hollow chamber or chambers.

11. A ski according to claim 1, wherein the ski has at least three adjacent hollow chambers with the fibre-reinforcement of the two lateral hollow chambers is comprised at least in part of carbon fibers, and the fibre-reinforcement of the other hollow chamber or chambers is of glass fibres.

12. A ski according to claim 1, wherein a cured synthetic resin of the hollow body forms a web filling the gap between the lateral bottom edge of the shell and the top surface of the lower, flat subassembly, preferably of the steel edge.

13. A ski according to claim 1, wherein the components of the flat, lower subassembly are composed only of the base and optionally steel edges.

14. A ski according to claim 1, wherein the shell is composed of an unstretched covering foil made from un-reinforced plastics material.

15. A ski, of monocoque design, in which the internal load-bearing construction is covered laterally and above by a shell made from un-reinforced plastics material, which joins onto a flat lower subassembly, composed of at least a base and steel edges, wherein a space enclosed by the shell formed from a moulded covering foil of plastics material, and the components of the lower, flat subassembly, comprises a hollow body composed of at least two adjacently located hollow chambers extending in the longitudinal direction of the ski, with walls made from fibre-reinforced plastics material, wherein each individual hollow chamber is completely enclosed by fibre-reinforced plastics material, so that between the at least two hollow chambers-vertical partition walls made from fibre-reinforced plastics material are formed.

16. Method for manufacturing a ski with the aid of a mould composed of a first half-mould and a second half-mould, in the hollow mould space of which the moulding of the ski takes place, comprising the steps of:

a) inserting structural components of the lower subassembly in the cavity of the first half-mould;

b) providing and positioning in the mould one or more tubular, synthetic resin-impregnated fibre-material sheet configurations with internal hoses of air-tight material,;

c) positioning in the mould a covering foil made from plastics material, provided with a decoration and/or an external protective foil, wherein the side edges of the of the covering foil overhang the cavity of the first half-mould;

d) placing the second half-mould, with a mould cavity corresponding to the side and to surface contours of the ski body, on the first half-mould, whereby the projecting edges of the covering foil are positioned, but not clamped, in the gaps in the edges between the second half-mould and first half-mould in a manner filling in said gaps;

e) inflating the internal air-tight hose or hoses inside the synthetic resin-fibre material tube(s) with compressed air, whereby they expand and the synthetic resin-fibre material tube(s) also expands, whereby the edge zones of the covering foil located in the gap in the edges between the second half-mould and the first half-mould are at least in part pulled out of the gap in the edge and the foil sits, without expansion or stretching, and without distortion of the decoration possibly applied, closely on the internal wall of the second half-mould; and, f) curing the synthetic resin of the synthetic resin-fibre material tube(s), while the internal pressure of the compressed air in the internal air-tight hose or hoses is retained, possibly with heat being supplied.

17. Method according to claim 16, including the step of supporting the edges of the covering foil on lateral projections of the first half-mould when they are laid on the synthetic resin-fibre material tubes.

18. Method according to claim 16, including the step of terminating the excess pressure in the internal air-tight hoses after curing of the synthetic resin of the synthetic resin-fibre material.

19. Method according to claim 16, including the step of removing the hoses from the hollow chambers after the termination of the internal excess pressure.

20. Method according to claim 16, wherein tubular braiding impregnated with synthetic resin is used for the synthetic resin-fibre material tubes.

21. Method according to claim 20, wherein fibre threads, aligned in the longitudinal direction of the synthetic resin-fibre material tubes, are woven into the tubular braiding.

22. Method according to claim 16, wherein carbon fibres are sometimes also added to the fibre reinforcement, for the most part composed of glass fibres, of the synthetic resin-fibre material tubes.

23. Method according to claim 16, wherein before being inserted in the mould, the side of the covering foil which faces inwards when the ski is finished is bonded to at least one strengthening layer made from load-bearing material for reasons of strength, preferably of fibre-reinforced plastics material or metal.

24. Method according to claim 16, wherein a protective foil is laminated onto the covering foil, which is removed after the removal of the skis from the mould.

25. Device for manufacturing a ski with a preferably heatable mould, composed of two half-moulds, wherein the lateral enclosing surfaces of the first half-mould and/or of the second half-mould are configured so that when the mould is closed, in the area of the enclosing surfaces which contains the edge zones of the covering foil, a gap, delimited by stops, is formed, the height of which is approximately equal to the thickness of the covering foil, optionally including the protective foil.

26. Device according to claim 25, wherein upwardly projecting projections are formed on the lateral enclosing surfaces of the first half-mould.

27. Device for implementing the method according to claim 16, with a preferably heatable mould, composed of two half-moulds, wherein preferably the first half-mould is provided with a compressed air connection leading to the mould cavity, onto which the air-tight hoses arranged inside the synthetic resin-fibre material tubes can be connected.

* * * * *